United States Patent [19]

Dolata et al.

[11] 4,348,926

[45] Sep. 14, 1982

[54] SAW CHAIN FOR MOTOR CHAIN SAWS

[75] Inventors: Hans Dolata, Waiblingen; Werner Meyle, Murr; Günther Weyda, Waiblingen-Hohenacker, all of Fed. Rep. of Germany

[73] Assignee: Andreas Stihl, Waiblingen, Fed. Rep. of Germany

[21] Appl. No.: 193,898

[22] Filed: Oct. 6, 1980

[30] Foreign Application Priority Data

Oct. 5, 1979 [DE] Fed. Rep. of Germany ..... 2940406

[51] Int. Cl.[3] ..... B27B 33/14

[52] U.S. Cl. ..... 83/833; 83/834; 83/174; 76/25 A

[58] Field of Search ..... 83/830, 833, 834, 174; 76/25 A

[56] References Cited

U.S. PATENT DOCUMENTS 2,912,020 11/1959 Consoletti ..... 83/834

3,545,508 12/1970 Tupper ..... 83/833

3,921,490 11/1975 Dolata et al. ..... 83/833

*Primary Examiner*—Donald R. Schran

*Attorney, Agent, or Firm*—Becker & Becker, Inc.

[57] ABSTRACT

A saw chain, for motor chain saws, provided with depth limiters, gauges, or members, and with cutting teeth respectively arranged, in the direction of cutting movement, behind a depth limiter. Each cutting tooth projects outwardly from a base body transverse to the direction of cutting movement of the saw chain, and is set or twisted relative to the plane of the base body, with each cutting tooth having a transverse cutter which is formed by a cutting back surface and an outer surface of the twisted cutting tooth. Each depth limiter is bent laterally out of the plane of the base body of the subsequent cutting tooth, and forms a rearwardly open, acute inclined or chamfered angle with this plane. This angle may range between 3° and 20°, and is preferably 9°. The leading region of the depth limiter may be provided with a continuously and uniformly curved, downwardly extending, rounded entry portion.

7 Claims, 5 Drawing Figures

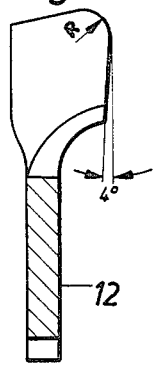
Fig. 2
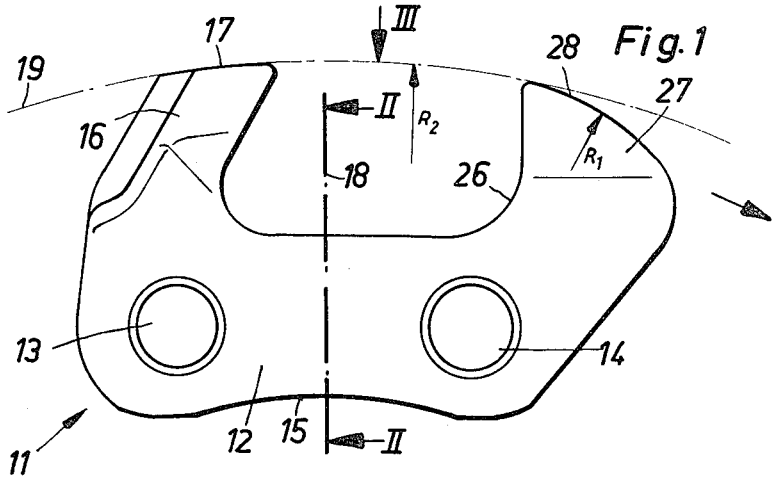
Fig. 1
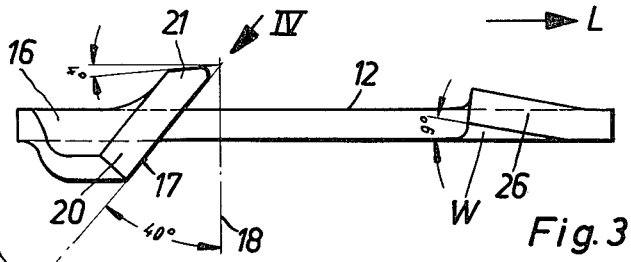
Fig. 3
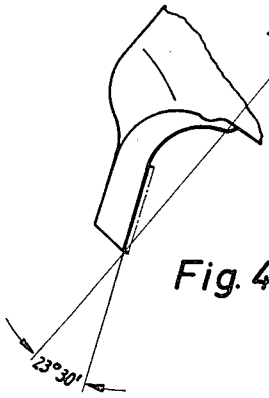
Fig. 4
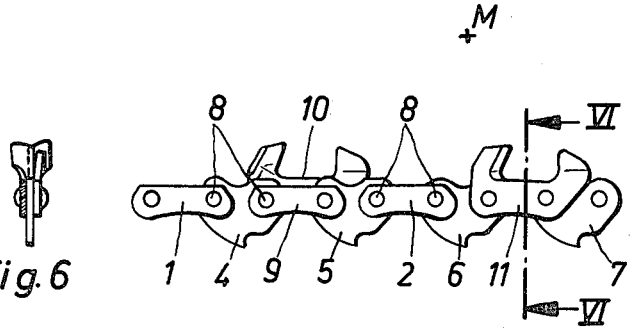
Fig. 5
Fig. 6

SAW CHAIN FOR MOTOR CHAIN SAWS

The present invention relates to a saw chain for motor chain saws, and is provided with depth limiting means and with cutting teeth respectively arranged, in the direction of cutting movement, behind a depth limiting means, with each cutting tooth projecting outwardly from a base body transverse to the direction of cutting movement of the saw chain, and set or twisted with respect to the plane of the base body, with each cutting tooth having a transverse cutter which is formed by a cutting back surface and an outer surface of the twisted cutting tooth.

German Offenlegungsschrift No. 23 02 779, which is basis for U.S. Pat. No. 3,921,490-Dolata et al issued Nov. 25, 1975, discloses a saw chain of this type. The twisted arrangement of the cutting teeth of such a chain makes possible to simultaneously resharpen or regrind the top surface and the front surface and the front surface of each cutting tooth in a common procedure together with the depth limiting means. In so doing, each depth limiting means during the grinding procedure enters or engages the grinding element before the subsequent cutting tooth, so that the grinding grains first grind the depth limiting means. Since with the known embodiment, the depth limiting means lies in the same vertical plane as the base body itself, its leading front edge, which extends transverse to the rotational direction, engages with the entire width thereof completely and simultaneously upon the grinding grain of the sharpening element. The sharpening element accordingly is strongly loaded or stressed in an impact or shock manner by the front edge thereof along the entire width of the depth limiting means. By means of this sudden or impact-like engagement of the depth limiting means, the abrasive grain wears off severely, and there exists additionally the danger that individual abrasive grains, as a consequence of the high loading, are torn out and that the sharpening element wears too quickly. This is especially disadvantageous if the sharpening element is embodied as a throwaway element, and consequently comprises only a relatively thin grinding-means layer. An unfavorable heat development results from the sudden or shock-like engagement of the front edge and the consequent great loading.

As a result of the strong loading of the grinding-means layer by way of the frontal engagement or introduction of the front edge of the depth limiting means, additionally no sufficient grinding quality is assured for the grinding of the subsequent cutting tooth. The cutting teeth, however, ought to be reground especially carefully, and require for this purpose a grinding layer which is used up to the least possible extent, so that the part of the tooth which is loaded or stressed the most, namely the tooth cutter, receives an accurate uniform grind for the purpose of being able to develop the complete cutting effect thereof.

It is an object of the present invention to reduce the wear of the grinding means by the depth limiting means.

This object, and other objects and advantages of the present invention, will appear more clearly from the following specification in connection with the accompanying drawing, which illustrates a saw chain having features in accordance with the present invention:

FIG. 1 is a side view of a cutting tooth member embodied in accordance with the present invention;

FIG. 2 is a cross section taken along line II—II of FIG. 1;

FIG. 3 is a plan view taken in the direction of the arrow III of FIG. 1;

FIG. 4 is a view of the cutting edge of the cutting tooth taken in the direction of the arrow IV of FIG. 3;

FIG. 5 shows the saw chain in a segmented manner in a view from the side with several chain members and two inventively embodied cutting tooth members; and FIG. 6 is a cross section through one of the cutting tooth members taken along line VI—VI of FIG. 5.

The saw chain of the present invention is characterized primarily in that each depth limiting means is bent laterally out of the plane of the base body of the subsequent cutting tooth, and forms a rearwardly open, acute inclined or chamfered angle with this plane. This angle may be between 3° and 20°, and is preferably 9°.

By bending the depth limiting means laterally outwardly, there is achieved that during grinding, that surface of the depth limiting means to be ground is widened by the measure of the lateral bending out, whereby not only the stability of the depth limiting means during entry or introduction into the sharpening device, but also consequently and simultaneously the stability of the chain during the grinding procedure is improved. As a consequence of the inclined position of the depth limiting means, also the front edge of the depth limiting means is positioned at a slight incline, so that a kind of drawing or pulling grinding procedure occurs during engagement of this front edge upon the sharpening element. The abrasive grains of the grinding element are therefore not simultaneously engaged by the front edge, but rather are sequentially engaged during the feeding or advance movement and consequently are loaded or stressed in a manner to conserve and protect them. A greater stability is obtained by the inventive embodiment of the depth limiting means as a consequence of better guidance of the depth limiting means during the grinding procedure, and simultaneously a reduction of the loading of the grinding element itself is attained along with a correspondingly longer service life of the grinding element.

A further advantage of the present invention exists therein that as a consequence of the smooth or gentle entry or introduction of the depth limiting means into the grinding element, and the smaller loading of the abrasive grains themselves, there is obtained a better grinding effect in the region of the cutting tooth, which, as viewed in the direction of cutting movement, is seated or located behind the depth limiting means on the same base body. As a consequence of the inclined positioning of the depth limiting means, the grinding element is loaded over a widened surface while having to remove an identical material quantity, so that the grinding surface is less loaded and, with less wear, there is available a more uniform grinding-means layer of the grinding element for the subsequent grinding procedure on the cutting tooth. The cutting teeth are therefore ground considerably better and more uniformly, especially in the track or path region of the depth limiting means.

According to a further embodiment of the present invention, the leading region of the depth limiting means can be provided with a continuously and uniformly curved, downwardly extending, entry or introductory rounded portion. Consequently, a smooth entry or introduction of the upper surface of the depth limiting means into the sharpening element is attained. The sudden or shock-like movements of the chain arising during entry or introduction of the depth limiting means into the grinding or sharpening element are hereby dampened, and the running of the chain is more stable.

It has proven especially advantageous if, with the inventive inclined positioning of the depth limiting means, the end segment of the depth limiting means projects laterally toward the same side as the tip of the cutting tooth over the common base body.

Referring now to the drawings in detail, FIG. 5 shows in nearly actual size a segment of an inventive saw chain, including two pairs of side members 1 and 2; as viewed in the direction of movement L of the saw chain, only the side member 1 arranged upon the right side of the saw chain has been shown, the same holding true for the side member 2 associated with the second pair of side members. In the illustrated chain segment of FIG. 5, which arrangement repeats itself several times over the length of the chain, one of four middle members 4,5,6,7 is arranged between each of the side member pairs 1 and 2. These middle members are pivotally or hingedly connected by means of chain or link pins 8.

A right side member 9 serves to connect the two middle members 4 and 5. This side member 9, together with the cutting tooth member 10 arranged on the left side of the chain away from the observer of FIG. 5, effects the articulated or pivotal connection on the link pin 8. This cutting tooth member 10, just like the second cutting tooth member 11, is inventively embodied, as will be described in further detail subsequently. The second cutting tooth member 11 is embodied in a mirror image to the first cutting tooth member 10 with respect to a longitudinal middle plane of the saw chain extending parallel to the plane of the drawing illustration. The second cutting tooth member 11 is described in further detail below with the aid of FIGS. 1 to 4.

The cutting tooth member 11 has a smooth or flat base body 12 which includes two spaced apart transverse bores 13 and 14 for receiving the link pins 8 illustrated in FIG. 5. Along the underside of the base body there is provided a slightly cylindrically curved recess 15. On the oppositely located upper side, a cutting tooth 16 projects from the base body 12. This cutting tooth 16 is twisted or set with respect to the base body 12 in such a manner (recognizable from FIG. 3), that the cutting edge 17 thereof defines an angle of approximately 40° with the transverse middle plane 18 indicated by the dot-dashed line II—II in FIG. 1.

For sharpening the cutting edge 17, the cutting tooth 16 is moved in a circular arc, indicated at 19, during passage thereof over a reversing or diverting roller arranged at the free end of a non-illustrated saw tongue; the cutting tooth is swung or pivoted about the center M of this circular arc 19. In this connection, the tooth back 20 of the cutting tooth 16 can be brought into engagement with and be ground by a grinding means which is not illustrated and likewise follows the circular arc 19.

A depth limiting means 26 is provided in front of the cutting tooth 16 when viewed in the direction of movement L. This depth means 26 is constructed integrally or in one piece with the base body 12, and extends as far as to the circular arc 19. This depth limiting means enters or contacts the sharpening element (not shown) before entry of the cutting tooth 16. As recognizable from FIG. 3, the depth limiting means is bent out of the plane of the base body 12, toward the same side on which the cutter 21 of the cutting tooth 16 projects laterally, to such an extent that it defines a rearwardly opened, acute inclined or chamfered angle w with respect to the direction of movement L or the plane of the base body; this angle may range between 3° and 20°, and is advantageously approximately 9°. The preceding portion 27 of the depth limiting means 26 is drawn forwardly in comparison to the known cutting tooth members, and is thereby rounded off with a radius R1 at the end face 28 thereof. This radius R1 is approximately half as large as a radius R2 which extends from the turning axis M to the grinding-circular arc 19. In this manner, the entire entry region of the depth limiting means 26 is free of edges, resulting in a smooth entry of the end face 28 of the depth limiting means or member, or depth gauge, into the non-illustrated sharpening element. By means of this smooth or gradual entry, the chain, which in itself runs uneven in a lateral direction and in height direction, is steadied insofar as the inevitably arising, sudden shock-like movements of the chain can be damped by the rounded-off and projecting embodiment of the front portion 27 of the depth limiting means 26.

The present invention is, of course, by no means limited to the specific disclosure of the specification and drawings, but also encompasses any modifications within the scope of the appended claims.

What we claim is:

1. A saw chain, for motor chain saws, having a plurality of cutting tooth members, each of which comprises:

a base body;

a depth limiter or gauge; and a cutting tooth arranged behind said depth limiter when viewed in the direction of cutting movement of said saw chain, said cutting tooth projecting outwardly from said base body transverse to the direction of cutting movement, and being twisted with respect to the plane of said base body, said cutting tooth being provided with a transverse cutter formed by a cutting back surface and an outer surface of said twisted cutting tooth, said depth limiter for automatically post-sharpening in common with said cutting tooth to the same extent during movement of said saw chain being bent laterally out of the plane of said base body and forming with this plane, when viewed in the direction of cutting movement, a rearwardly open, acute chamfered angle such that during post-sharpening there occurs a type of drawing or pulling grinding procedure in common over collective width of said cutting tooth and said depth limiter uniformly and accurately in one operation.

2. A saw chain cutting tooth member according to claim 1, in which said angle is between 3° and 20°.

3. A saw chain cutting tooth member according to claim 2, in which said angle is 9°.

4. A saw chain cutting tooth member according to claim 1, in which said depth limiter has a leading portion which is provided with a uniformly curved, downwardly extending, end face.

5. A saw chain cutting tooth member according to claim 4, in which said end face is rounded off.

6. A saw chain cutting tooth member according to claim 5, in which, during movement, said transverse cutter of said cutting tooth defines a circular arc having a first radius, and in which said rounded off end face is defined by a second radius which is approximately half as great as said first radius.

7. A saw chain cutting tooth member according to claim 1, in which said depth limiter is bent toward the same side of said base body as is said transverse cutter of said cutting tooth.

* * * * *